US008827267B2

(12) United States Patent
Hongo et al.

(10) Patent No.: US 8,827,267 B2
(45) Date of Patent: Sep. 9, 2014

(54) PAPER CONVEYING APPARATUS, RECOVERY METHOD, AND COMPUTER-READABLE, NON-TRANSITORY MEDIUM

(71) Applicant: PFU Limited, Kahoku (JP)

(72) Inventors: Masanobu Hongo, Kahoku (JP); Takayuki Umi, Kahoku (JP)

(73) Assignee: PFU Limited, Kahoku-shi (JP)

( * ) Notice: Subject to any disclaimer, the term of this patent is extended or adjusted under 35 U.S.C. 154(b) by 0 days.

(21) Appl. No.: 13/963,870

(22) Filed: Aug. 9, 2013

(65) Prior Publication Data

US 2014/0062009 A1 Mar. 6, 2014

(30) Foreign Application Priority Data

Sep. 5, 2012 (JP) ..... 2012-195325

(51) Int. Cl.

| | |
|---|---|
| ***B65H 7/02*** | (2006.01) |
| ***G03G 15/00*** | (2006.01) |
| ***B65H 7/06*** | (2006.01) |
| ***B41J 11/00*** | (2006.01) |

(52) U.S. Cl.

CPC ..... *B65H 7/06* (2013.01); *G03G 2215/00637* (2013.01); *B41J 11/006* (2013.01); *G03G 15/70* (2013.01)

USPC ..... 271/258.01; 271/259; 399/21; 399/19; 399/18; 399/17

(58) Field of Classification Search

CPC ..... B65H 7/02; B65H 7/06; G03G 15/70

USPC ..... 271/258.01, 259; 399/21, 19, 18, 17

See application file for complete search history.

(56) References Cited

U.S. PATENT DOCUMENTS

| | | | |
|---|---|---|---|
| 3,603,680 | A | 9/1971 | Barton |
| 7,502,570 | B2 | 3/2009 | Nishimura |

(Continued)

FOREIGN PATENT DOCUMENTS

| | | | |
|---|---|---|---|
| JP | 57-169767 | | 10/1982 |
| JP | 03175460 | A * | 7/1991 |

(Continued)

OTHER PUBLICATIONS

Office action mailed Jul. 16, 2013 in JP 2012-195225, including English translation, 7pp.

(Continued)

*Primary Examiner* — Luis A Gonzalez

(74) *Attorney, Agent, or Firm* — Christie, Parker & Hale, LLP

(57) ABSTRACT

There are provided a paper conveying apparatus, a jam detection method and a computer-readable, non-transitory medium that can improve the user friendliness in the recovery processing when determining that a jam has occurred during conveyance of a paper. The paper conveying apparatus includes a sound signal generator for generating a sound signal, a sound jam detector for determining whether a jam has occurred based on the sound signal, a control module for stopping conveyance of a paper when the sound jam detector determines that the jam has occurred, a paper state detector for detecting a state of the paper, and a recovery processing module for automatically performing a recovery processing which resumes conveyance of the paper in accordance with a content of the detection of the paper state detector after stopping the conveyance of the paper by the control module.

8 Claims, 15 Drawing Sheets

(56) References Cited

U.S. PATENT DOCUMENTS

| | | | | |
|---|---|---|---|---|
| 7,587,299 | B2 | 9/2009 | Miyasaka et al. | |
| 8,567,777 | B2 | 10/2013 | Syracuse et al. | |
| 8,585,050 | B2 | 11/2013 | Syracuse et al. | |
| 2005/0189707 | A1 | 9/2005 | Sano et al. | |
| 2007/0018376 | A1 | 1/2007 | Sano et al. | |
| 2007/0177887 | A1* | 8/2007 | Haas et al. | 399/17 |
| 2009/0003857 | A1 | 1/2009 | Kuramochi et al. | |
| 2009/0041485 | A1 | 2/2009 | Shoji et al. | |
| 2012/0019841 | A1 | 1/2012 | Schaertel et al. | |
| 2012/0235921 | A1 | 9/2012 | Laubach | |
| 2012/0235929 | A1 | 9/2012 | Hongo et al. | |
| 2013/0093136 | A1 | 4/2013 | Sakharshete et al. | |
| 2013/0140757 | A1 | 6/2013 | Phinney et al. | |
| 2013/0300056 | A1 | 11/2013 | Kai | |
| 2014/0054252 | A1 | 2/2014 | Woodley et al. | |
| 2014/0054840 | A1 | 2/2014 | Umi et al. | |
| 2014/0054841 | A1 | 2/2014 | Morikawa et al. | |
| 2014/0054849 | A1 | 2/2014 | Morikawa et al. | |
| 2014/0054850 | A1 | 2/2014 | Umi et al. | |
| 2014/0054851 | A1 | 2/2014 | Morikawa et al. | |
| 2014/0054852 | A1 | 2/2014 | Hongo et al. | |
| 2014/0062008 | A1* | 3/2014 | Hongo et al. | 271/258.01 |

FOREIGN PATENT DOCUMENTS

| | | | |
|---|---|---|---|
| JP | 5-97283 | | 4/1993 |
| JP | 5-97284 | | 4/1993 |
| JP | 8-2746 | | 1/1996 |
| JP | 11-116098 | | 4/1999 |
| JP | 2001302021 | A * | 10/2001 |
| JP | 2005-082350 | | 3/2005 |
| JP | 2005-249819 | | 9/2005 |
| JP | 2006-201316 | | 8/2006 |
| JP | 2006-290515 | | 10/2006 |
| JP | 2006-322947 | | 11/2006 |
| JP | 2007-86173 | | 4/2007 |
| JP | 2008-207885 | | 9/2008 |
| JP | 2009-249046 | | 10/2009 |
| JP | 2010-030772 | | 2/2010 |
| JP | 2010-54558 | | 3/2010 |
| JP | 2011-180481 | | 9/2011 |
| JP | 2011-254248 | | 12/2011 |
| JP | 2012-6738 | | 1/2012 |

OTHER PUBLICATIONS

Office action mailed Jul. 16, 2013 in JP 2012-195325, including English translation, 6pp.

Office action mailed Jul. 9, 2013 in JP 2012-203504, including English translation 5pp.

Office action mailed Jul. 16, 2013 in JP 2012-185219, including English translation, 5pp.

Office action mailed Jul. 9, 2013 in JP 2012-202627, including English translation, 5pp.

Office action mailed Jul. 16, 2013 in JP 2012-195225, including English translation, 6pp.

* cited by examiner

PAPER CONVEYING APPARATUS, RECOVERY METHOD, AND COMPUTER-READABLE, NON-TRANSITORY MEDIUM

CROSS-REFERENCE TO RELATED APPLICATIONS

This application is based upon and claims the benefit of priority of prior Japanese Patent Application No. 2012-195325, filed on Sep. 5, 2012, the entire contents of which are incorporated herein by reference.

TECHNICAL FIELD

Embodiments discussed in the present specification relate to paper conveying technology.

BACKGROUND

In a paper conveying apparatus of an image reading apparatus, image copying apparatus, etc., sometimes a jam occurs when the paper moves along the conveyance path. In general, a paper conveying apparatus is provided with the function of determining whether a jam has occurred by a paper being conveyed to a predetermined position inside the conveyance path within a predetermined time from the start of conveyance of the paper and of stopping the operation of the apparatus when a jam has occurred.

On the other hand, if a jam occurs, a large sound is generated in the conveyance path, so the paper conveying apparatus can determine whether a jam has occurred based on the sound which is generated on the conveyance path and thereby detect the occurrence of a jam without waiting for the elapse of the predetermined time.

A jam detection apparatus of a copier which converts the sound which is generated on the conveyance path to an electrical signal and determines that a jam has occurred when the time when the signal is over a reference level exceeds a reference value has been disclosed (see Japanese Laid-open Patent Publication No. 57-169767).

SUMMARY

In the past, when a paper conveying apparatus determines that a jam has occurred and stops operation of the apparatus, the user has had to open the apparatus and remove the jammed paper. The recovery work was troublesome.

Accordingly, it is an object of the present invention is to provide a paper conveying apparatus, recovery method which can improve the user friendliness in the recovery processing when determining that a jam has occurred during conveyance of a paper, and a computer-readable, non-transitory medium storing a computer program for causing a computer to implement such recovery method.

According to an aspect of the apparatus, there is provided a paper conveying apparatus. The paper conveying apparatus includes a sound signal generator for generating a sound signal, a sound jam detector for determining whether a jam has occurred based on the sound signal, a control module for stopping conveyance of a paper when the sound jam detector determines that the jam has occurred, a paper state detector for detecting a state of the paper, and a recovery processing module for automatically performing a recovery processing which resumes conveyance of the paper in accordance with a content of the detection of the paper state detector after stopping the conveyance of the paper by the control module.

According to an aspect of the method, there is provide a recovery method. The recovery method includes acquiring a sound signal, determining whether a jam has occurred based on the sound signal, stopping conveyance of a paper when determining that the jam has occurred in the determining step, acquiring a state of the paper; and automatically performing, by a computer, a recovery processing which resumes conveyance of the paper in accordance with a content of detection of the paper state after stopping the conveyance of the paper in the stopping step.

According to an aspect of the computer-readable, non-transitory medium storing a computer program, the computer program causes a computer to execute a process, including acquiring a sound signal, determining whether a jam has occurred based on the sound signal, stopping conveyance of a paper when determining that the jam has occurred in the determining step, acquiring a state of the paper, and automatically performing a recovery processing which resumes conveyance of the paper in accordance with a content of detection of the paper state after stopping the conveyance of the paper in the stopping step.

The object and advantages of the invention will be realized and attained by means of the elements and combinations particularly pointed out in the claims. It is to be understood that both the foregoing general description and the following detailed description are exemplary and explanatory and are not restrictive of the invention, as claimed.

DESCRIPTION OF EMBODIMENTS

Hereinafter, a paper conveying apparatus, recovery method, and computer program according to an embodiment, will be described with reference to the drawings. However, note that the technical scope of the invention is not limited to these embodiments and extends to the inventions described in the claims and their equivalents.

Figure 1:
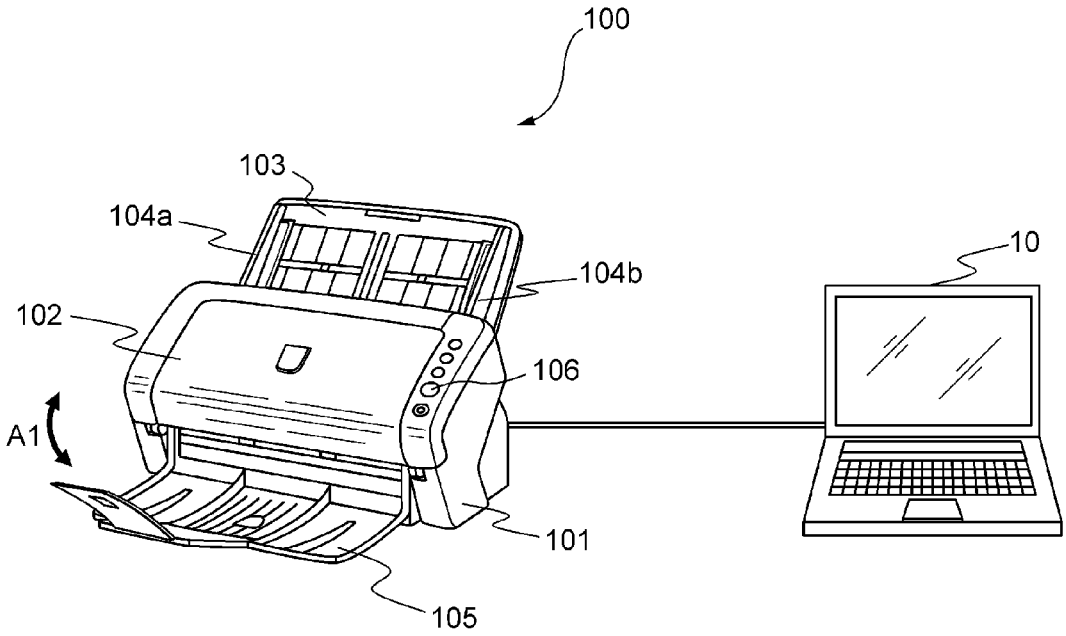
FIG. 1 is a perspective view which shows a paper conveying apparatus 100 and image processing apparatus 10 according to an embodiment.

FIG. 1 is a perspective view which shows a paper conveying apparatus 100 which are configured as an image scanner, and an information processing apparatus 10, according to an embodiment.

The paper conveying apparatus 100 includes a lower housing 101, an upper housing 102, a paper tray 103, an ejection tray 105, an operation button 106, etc., and is connected to an information processing apparatus (for example, personal computer, portable data terminal, etc.)

The lower housing 101 and the upper housing 102 are formed by plastic material. The upper housing 102 is arranged at a position which covers the top surface of the paper conveying apparatus 100 and is engaged with the lower housing 101 by hinges so as to be able to be opened and closed at the time of a paper jam, at the time of cleaning of the inside of the paper conveying apparatus 100, etc.

The paper tray 103 is engaged with the lower housing 101 in a manner enabling a paper to be placed. The paper tray 103 is provided with side guides 104*a* and 104*b* which can be moved in a direction perpendicular to a conveyance direction of the paper, that is, to the left and right directions from the conveyance direction of the paper. By positioning the side guides 104*a* and 104*b* to match with the width of the paper, it is possible to limit the width direction of the paper.

The ejection tray 105 is engaged with the lower housing 101 by hinges so as to be able to pivot in the direction which is shown by an arrow mark A1. In the opened state as shown in FIG. 1, the ejected paper can be held.

The operation button 106 is arranged on the surface of the upper housing 102. If pushed, it generates and outputs an operation detection signal.

Figure 2:
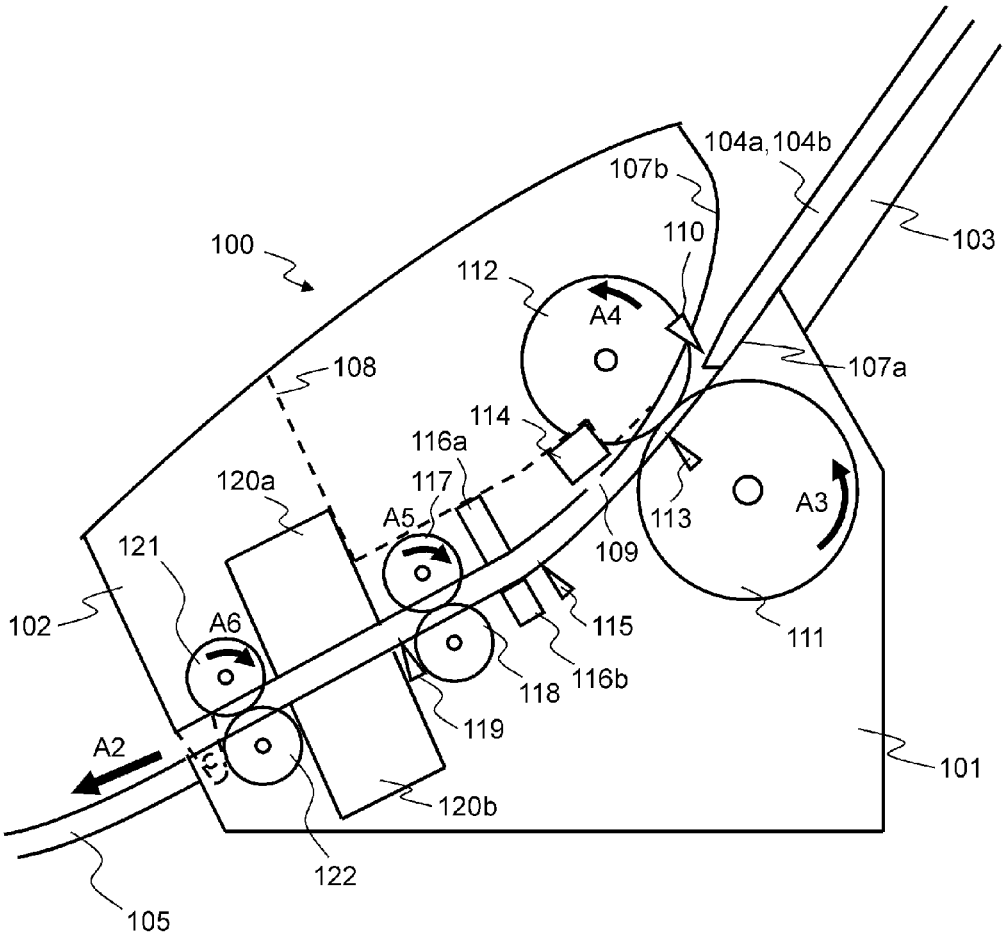
FIG. 2 is a view for explaining an example of a conveyance route at an inside of a paper conveying apparatus 100.

FIG. 2 is a view for explaining an example of the conveyance route at the inside of the paper conveying apparatus 100.

The conveyance route at the inside of the paper conveying apparatus 100 has a first position detector 110, a paper feed roller 111, a retard roller 112, an opening detector 113, a microphone 114, a second position detector 115, an ultrasonic transmitter 116*a*, an ultrasonic receiver 116*b*, a first conveyor roller 117, a first driven roller 118, a third position detector 119, a first image capture unit 120*a*, a second image capture unit 120*b*, a second conveyor roller 121, a second driven roller 122, etc.

The top surface of the lower housing 101 forms the lower guide 107*a* of the conveyance path of the paper, while the bottom surface of the upper housing 102 forms the upper guide 107*b* of the conveyance path of the paper. In FIG. 2, the arrow mark A2 shows the conveyance direction of the paper. Below, "upstream" means upstream of the conveyance direction A2 of the paper, while "downstream" means downstream of the conveyance direction A2 of the paper.

The first position detector 110 has a contact detection sensor which is arranged at an upstream side of the paper feed roller 111 and the retard roller 112 and detects if a paper is placed on the paper tray 103. The first position detector 110 generates and outputs a first position detection signal which changes in signal value between a state in which a paper is placed on the paper tray 103 and a state in which one is not placed.

The opening detector 113 has a contact detection sensor which is arranged at a downstream side of the paper feed roller 111 and retard roller 112 and an upstream side of the first conveyor roller 117 and first driven roller 118 and detects if the upper side housing 102 is in an open state, that is, if the paper conveying apparatus 100 is in an open state. The opening detector 113 generates and outputs an opening detection signal which changes in signal value between the state where the upper side housing 102 is open and the state where it is closed.

The microphone 114 is an example of a sound detector, is provided near a conveyance path of a paper, detects the sound generated by a paper during conveyance of the paper, and generates and outputs an analog signal corresponding to the detected sound. The microphone 114 is arranged at the downstream side of the paper feed roller 111 and the retard roller 112 while fastened to the frame 108 at the inside of the upper housing 102. A hole 109 is provided in the upper guide 107*b* facing the microphone 114, so that the sound generated by the paper during conveyance of the paper can be more accurately detected by the microphone 114.

The second position detector 115 has a contact detection sensor which is arranged at a downstream side of the paper feed roller 111 and the retard roller 112 and at an upstream side of the first conveyor roller 117 and first driven roller 118 and detects if there is a paper present at that position. The second position detector 115 generates and outputs a second position detection signal which changes in signal value between a state at which there is a paper at that position and a state where there is no paper there.

The ultrasonic transmitter 116*a* and the ultrasonic receiver 116*b* are an example of an ultrasonic detector, and are arranged near the conveyance path of the paper so as to face each other across the conveyance path. The ultrasonic transmitter 116*a* transmits an ultrasonic wave. Note that, the reason why the ultrasonic wave transmitter 116*a* transmits an ultrasonic wave at a predetermined timing (at intervals of a predetermined time) is to prevent the ultrasonic wave transmitter 116*a* from being affected by an ultrasonic wave which is reflected by the paper. On the other hand, the ultrasonic receiver 116*b* detects an ultrasonic wave which is transmitted by the ultrasonic transmitter 116*a* and passes through the paper or papers, and generates and outputs an ultrasonic signal comprised of an electrical signal corresponding to the detected ultrasonic wave. Below, the ultrasonic transmitter 116*a* and the ultrasonic receiver 116*b* will sometimes be referred to altogether as the "ultrasonic sensor 116".

The third position detector 119 has a contact detection sensor which is arranged at a downstream side of the first conveyor roller 117 and the first driven roller 118 and an upstream side of the first image capture unit 120*a* and the second image capture unit 120*b* and detects if there is a paper at that position. The third position detector 119 generates and outputs a third position detection signal which changes in signal value between a state where there is a paper at that position and a state where there is no such paper there.

The first image capture unit 120*a* has a CIS (contact image sensor) of an equal magnification optical system type which is provided with an image capture element using CMOS's (complementary metal oxide semiconductors) which are arranged in a line in the main scan direction. This CIS reads the back surface of the paper and generates and outputs an analog image signal. Similarly, the second image capture unit 120*b* has a CIS of an equal magnification optical system type which is provided with an image capture element using CMOS's which are arranged in a line in the main scan direction. This CIS reads the front surface of the paper and generates and outputs an analog image signal. Note that, it is also possible to arrange only one of the first image capture unit 120*a* and the second image capture unit 120*b* and read only one surface of the paper. Further, instead of a CIS, it is also possible to utilize an image capturing sensor of a reduced magnification optical system type using CCD's (charge coupled devices). Below, the first image capture unit 120*a* and the second image capture unit 120*b* will sometimes be referred to overall as the "image capture units 120". The image capture units 120 are an example of an image reader for reading an image from a paper.

A paper which is placed on the paper tray 103 is conveyed between the lower guide 107*a* and the upper guide 107*b* toward the paper conveyance direction A2 by rotation of the paper feed roller 111 in the direction of the arrow mark A3 of FIG. 2. The retard roller 112 rotates in the direction of the arrow mark A4 of FIG. 2 at the time of paper conveyance. Due to the action of the paper feed roller 111 and the retard roller 112, when the paper tray 103 has a plurality of papers placed on it, among the papers which are placed on the paper tray 103, only the paper which is in contact with the paper feed roller 111 is separated. The conveyance of papers other than the separated paper is restricted (prevention of multifeed). The paper feed roller 111 and the retard roller 112 function as a paper separator.

A paper is fed between the first conveyor roller 117 and the first driven roller 118 while being guided by the lower guide 107*a* and the upper guide 107*b*. The paper is sent between the first image capture unit 120*a* and the second image capture unit 120*b* by the first conveyor roller 117 rotating in the direction of the arrow mark A5 of FIG. 2. The paper which is read by the image capture unit 120 is ejected onto the ejection tray 105 by the second conveyor roller 121 rotating in the direction of the arrow mark A6 of the FIG. 2.

Figure 3:
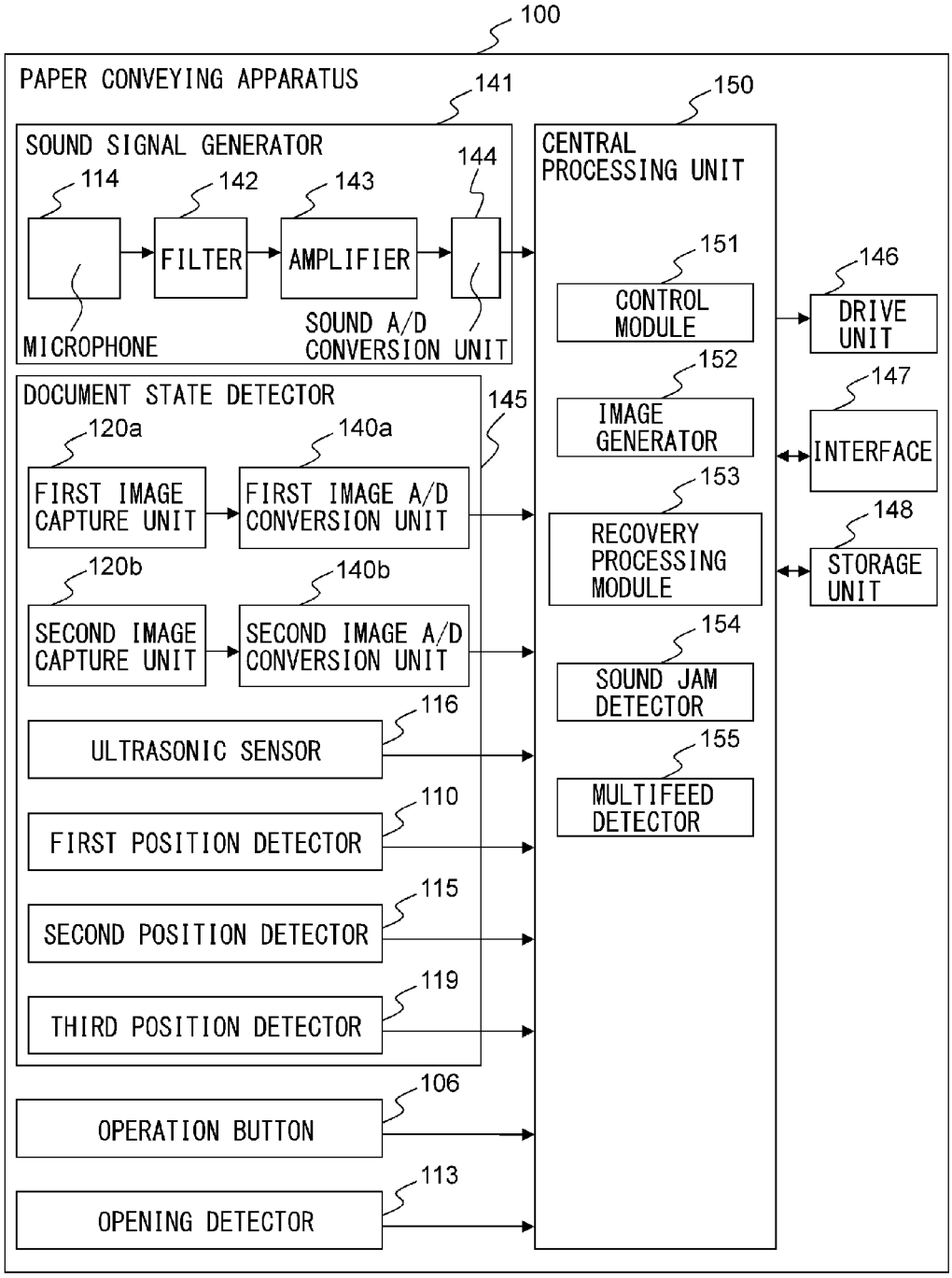
FIG. 3 is an example of a block diagram which shows a schematic configuration of a paper conveying apparatus 100.

FIG. 3 is an example of a block diagram which shows the general configuration of a paper conveying apparatus 100.

The paper conveying apparatus 100, in addition to the above-mentioned configuration, further has sound signal generator 141, a paper state detector 145, a drive unit 146, an interface 147, a storage unit 148, a central processing unit 150, etc.

The sound signal generator 141 includes a microphone 114, a filter 142, an amplifier 143, a sound A/D conversion unit 144, etc., and generates a sound signal. The filter 142 applies a bandpass filter which passes a predetermined frequency band of a signal to an analog signal which is output from the microphone 114 and outputs it to the amplifier 143. The amplifier 143 amplifies the signal which is output from the filter 142 and outputs it to the sound A/D conversion unit 144. The sound A/D converter 144 samples the analog signal which is output from the amplifier 143 by a predetermined sampling rate to convert it to a digital signal and outputs it to the central processing unit 150. Below, a signal which is output by the sound signal generator 141 will be referred to as a "sound signal".

Note that, the sound signal generator 141 is not limited to this. The sound signal generator 141 may include only the microphone 114, while the filter 142, the amplifier 143, and the sound A/D conversion unit 144 may be provided outside of the sound signal generator 141. Further, the sound signal generator 141 may include only the microphone 114 and the filter 142 or only the microphone 114, the filter 142, and the amplifier 143.

The paper state detector 145 includes a first image capture unit 120*a*, a first image A/D converter 140*a*, a second image capture unit 120*b*, a second image A/D converter 140*b*, an ultrasonic wave sensor 116, a first position detector 110, a second position detector 115, a third position detector 119, etc. and detects the state of a paper.

The first image A/D conversion unit 140*a* converts an analog image signal which is output from the first image capture unit 120*a* from an analog to digital format to generate digital image data which it then outputs to the central processing unit 150. Similarly, the second image A/D conversion unit 140*b* converts the analog image signal which is output from the second image capture unit 120*b* from an analog to digital format to generate digital image data which it then outputs to the central processing unit 150. Below, these digital image data will be referred to as the "read image".

The drive unit 146 includes one or more motors and uses control signals from the central processing unit 150 to rotate the paper feed roller 111, the retard roller 112, the first conveyor roller 117, and the second conveyor roller 121 and operate to convey a paper.

The interface 147 has, for example, a USB or other serial bus-based interface circuit and electrically connects with the information processing apparatus 10 to send and receive a read image and various types of information. Further, it is also possible to connect a flash memory etc., to the interface 147 so as to store the read image.

The storage unit 148 has a RAM (random access memory), ROM (read only memory), or other memory device, a hard disk or other fixed disk device, or flexible disk, optical disk, or other portable storage device. Further, the storage unit 148 stores a computer program, database, tables, etc., which are used in various processing of the paper conveying apparatus 100. The computer program may be installed on the storage unit 148 from a computer-readable, non-transitory medium such as a compact disk read only memory (CD-ROM), a digital versatile disk read only memory (DVD-ROM), or the like by using a well-known setup program or the like. Furthermore, the storage unit 148 stores the read image.

The central processing unit 150 is provided with a CPU (central processing unit) and operates based on a program which is stored in advance in the storage unit 148. Note that, the central processing unit 150 may also be comprised of a DSP (digital signal processor), LSI (large scale integrated circuit), ASIC (application specific integrated circuit), FPGA (field-programming gate array), etc.

The central processing unit 150 is connected to the operation button 106, sound signal generator 141, paper state detector 145, drive unit 146, interface 147, and storage unit 148 and controls these units.

The central processing unit 150 control a drive operation of the drive unit 146, control a paper read operation of the image capture unit 120, etc., to acquire a read image. Further, the central processing unit 150 has a control module 151, an image generator 152, a sound jam detector 153, a position jam detector 154, and a multifeed detector 155, etc. These units are functional modules which are realized by software which operate on a processor. Note that, these units may be comprised of respectively independent integrated circuits, a microprocessor, firmware, etc.

Figure 4:
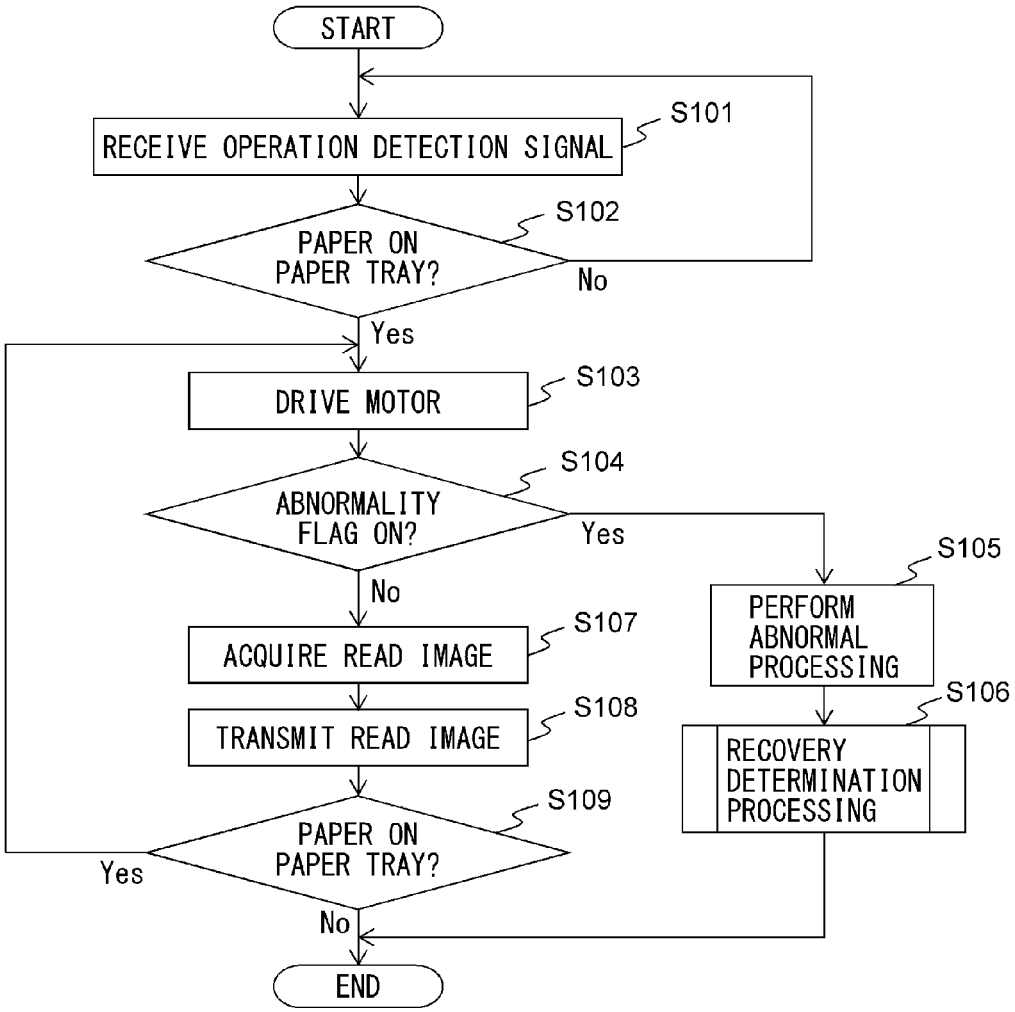
FIG. 4 is a flow chart which shows an example of operation of overall processing of a paper conveying apparatus 100.

FIG. 4 is a flow chart which shows an example of operation of overall processing of the paper conveying apparatus 100.

Below, referring to the flow chart which is shown in FIG. 4, an example of the operation of the overall processing of the paper conveying apparatus 100 will be explained. Note that, the flow of the operation which is explained below is performed based on a program which is stored in advance in the storage unit 148 mainly by the central processing unit 150 in cooperation with the elements of the paper conveying apparatus 100.

First, the central processing unit 150 stands by until a user pushes the operation button 106 and an operation detection signal is received from the operation button 106 (step S101).

Next, the central processing unit 150 determines whether the paper tray 103 has a paper placed on it based on the first position detection signal which was received from the first position detector 110 (step S102).

If the paper tray 103 does not have a paper placed on it, the central processing unit 150 returns the processing to step S101 and stands by until newly receiving an operation detection signal from the operation button 106.

On the other hand, when the paper tray 103 has a paper placed on it, the central processing unit 150 drives the drive unit 146 to rotate the paper feed roller 111, retard roller 112, first conveyor roller 117, and second conveyor roller 121 and convey the paper (step S103).

Next, the control module 151 determines whether an abnormality flag is ON or not (step S104). This abnormality flag is set OFF at the time of startup of the paper conveying apparatus 100 and is set ON if a later explained abnormality detection processing determines that an abnormality has occurred.

When the abnormality flag is ON, the control module 151, as an abnormal processing, stops the drive unit 146 to stop the conveyance of the paper, uses a not shown speaker, LED (light emitting diode), etc. to notify the user of the occurrence of an abnormality, sets the abnormality flag OFF (step S105).

Next, the recovery processing module 153 performs recovery determination processing (step S106) and ends the series of steps. The recovery processing module 153 determines the state of a paper based on the content of detection of the paper state detector 145 in the recovery determination processing and performs recovery processing which resumes conveyance of the paper in accordance with the results of determination. Details of the recovery determination processing will be explained later.

On the other hand, when the abnormality flag is not ON, the image generator 152 makes the first image capture unit 120*a* and the second image capture unit 120*b* read the conveyed paper and acquires the read image through the first image A/D conversion unit 140*a* and the second image A/D conversion unit 140*b* (step S107).

Next, the central processing unit 150 transmits the acquired read image through the interface 147 to a not shown information processing apparatus (step S108). Note that, when not connected to an information processing apparatus, the central processing unit 150 stores the acquired read image in the storage unit 148.

Next, the central processing unit 150 determines whether the paper tray 103 has a paper remaining thereon based on the first position detection signal which was received from the first position detector 110 (step S109).

When the paper tray 103 has a paper remaining thereon, the central processing unit 150 returns the processing to step S103 and repeats the processing of steps S103 to S109. On the other hand, when the paper tray 103 does not have any paper remaining thereon, the central processing unit 150 ends the series of processing.

Figure 5:
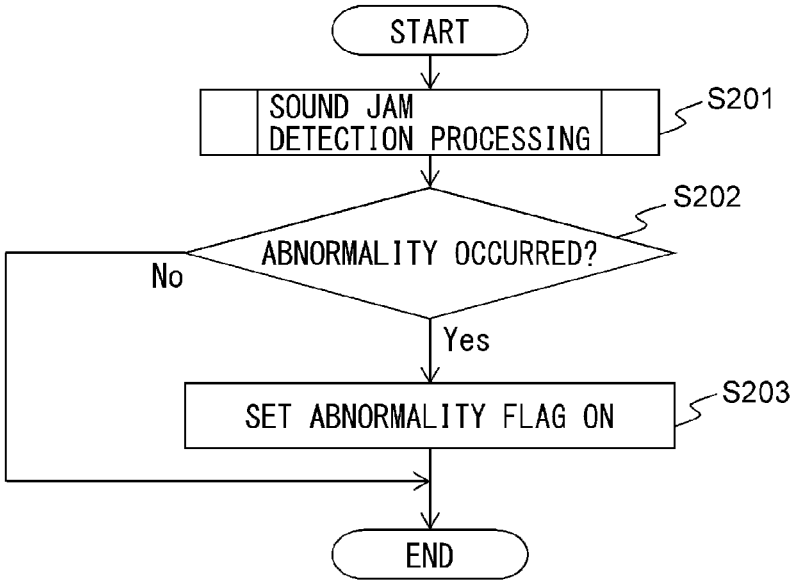
FIG. 5 is a flow chart which shows an example of an abnormality detection of the paper conveyance.

FIG. 5 is a flow chart which shows an example of an abnormality detection of the paper conveyance.

The flow of operation which is explained below is executed based on a program which is stored in advance in the storage unit 148 mainly by the central processing unit 150 in cooperation with the elements of the paper conveying apparatus 100.

First, the sound jam detector 153 executes sound jam detection processing (step S201). In the sound jam detection processing, the sound jam detector 153 determines whether a jam has occurred based on the sound signal which was acquired from the sound signal generator 141. Below, sometimes a jam which is determined to exist by the sound jam detector 153 based on a sound signal will be called a "sound jam". Details of the sound jam detection processing will be explained later.

Next, the control module 151 determines whether an abnormality has occurred in the paper conveyance processing (step S202). The control module 151 determines that an abnormality has occurred if at least one of a sound jam, position jam, and paper multifeed has occurred.

Note that, the central processing unit 150 further determines whether a jam has occurred based on a second position detection signal and third position detection signal. The control module 151 may determine that an abnormality has occurred even when it is determined that a jam has occurred based on the second position detection signal and the third position detection signal.

The control module 151 sets the abnormality flag to ON (step S203) and ends the series of steps when an abnormality occurs in the paper conveyance processing. On the other hand, when no abnormality occurs in the paper conveyance processing, it ends the series of steps without particularly performing any further processing. Note that, the flow chart which is shown in FIG. 5 is repeatedly executed every predetermined time interval.

Figure 6:
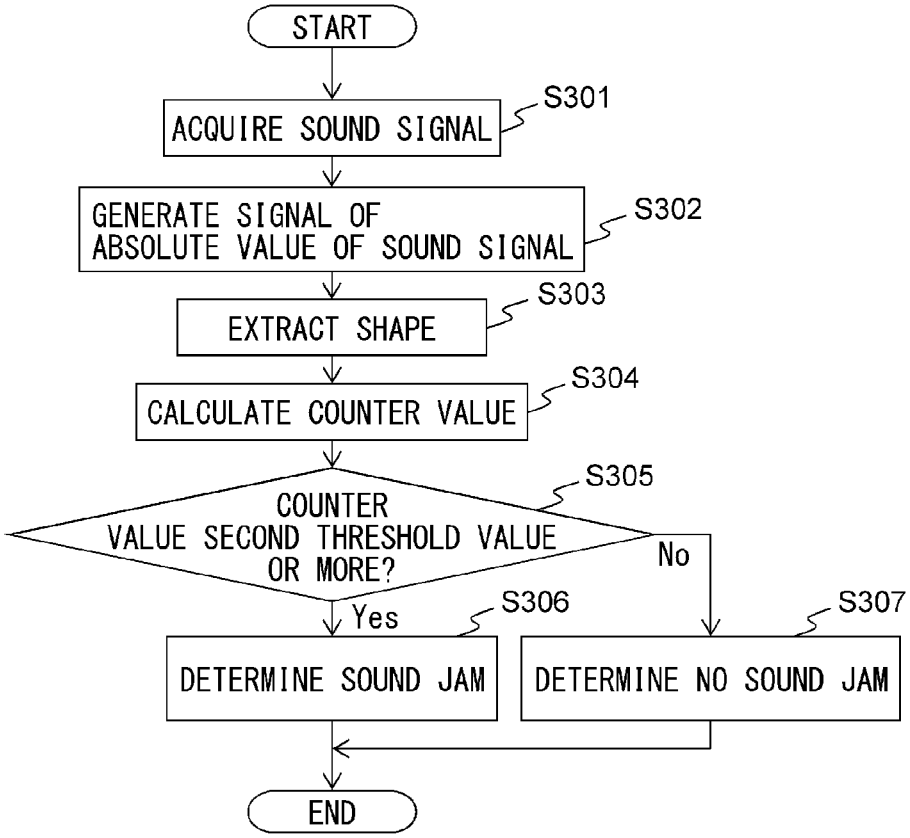
FIG. 6 is a flow chart which shows an example of operation of sound jam detection processing.

FIG. 6 is a flow chart which shows an example of operation of a sound jam detection processing.

The flow of operation which is shown in FIG. 6 is executed at step S201 of the flow chart which is shown in FIG. 5.

First, the sound jam detector 153 acquires a sound signal from the sound signal generator 141 (step S301).

Figure 7A:
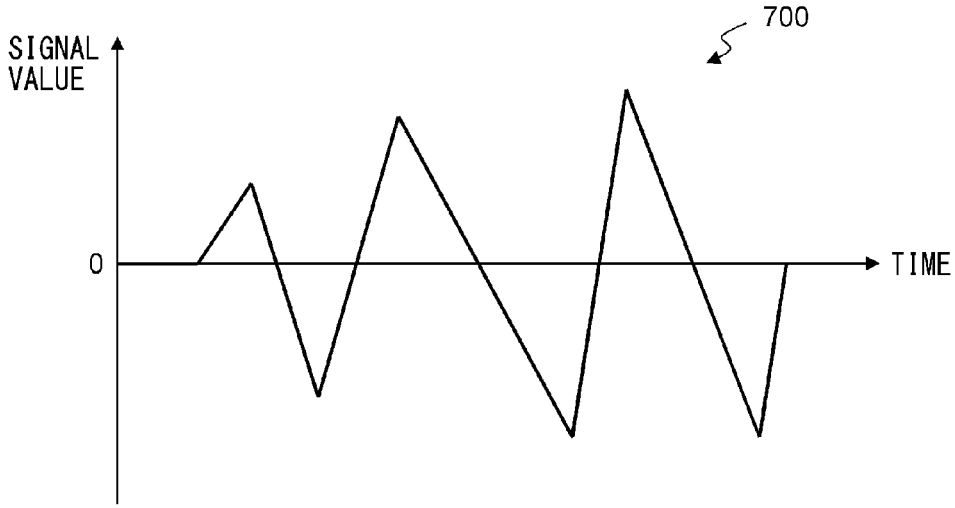
FIG. 7A is a graph which shows an example of a sound signal.

FIG. 7A is a graph which shows an example of a sound signal. The graph 700 which is shown in FIG. 7A shows a sound signal which is acquired from the sound signal generator 141. The abscissa of graph 700 shows the time, while the ordinate shows the signal value of the sound signal.

Next, the sound jam detector 153 generates a signal of the absolute value of the sound signal received from the sound signal generator 141 (step S302).

Figure 7B:
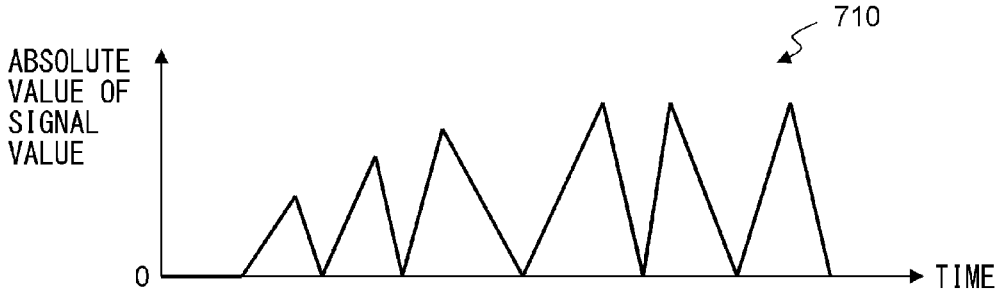
FIG. 7B is a graph which shows an example of a signal of an absolute value of a sound signal.

FIG. 7B is a graph which shows an example of the signal of the absolute value of the sound signal. The graph 710 which is shown in FIG. 7B shows the signal of the absolute value of the sound signal of the graph 700. The abscissa of graph 710 shows the time, while the ordinate shows the signal of the absolute value of the sound signal.

Next, the sound jam detector 153 extracts a shape of a signal of the absolute value of the sound signal (step S303). The sound jam detector 153 extracts the envelope as the shape of the signal of the absolute value of the sound signal.

Figure 7C:
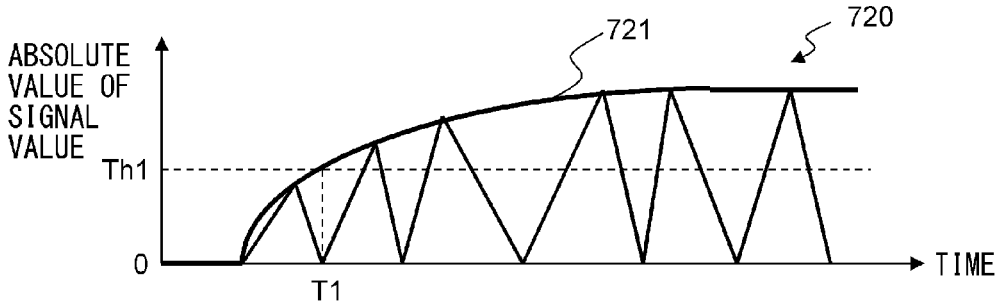
FIG. 7C is a graph which shows an example of a shape of a signal of an absolute value of a sound signal.

FIG. 7C is a graph which shows an example of the shape of a signal of the absolute value of the sound signal. The graph 720 which is shown in FIG. 7C shows the envelope 721 of the signal of the absolute value of the sound signal of the graph 710. The abscissa of the graph 720 shows the time, while the ordinate shows the absolute value of the signal value of the sound signal.

Next, the sound jam detector 153 calculates a counter value which it increases when the shape of the signal of the absolute value of the sound signal is a first threshold value Th1 or more and which it decreases when it is less than the first threshold value Th1 (step S304). The sound jam detector 153 determines whether the value of the envelope 721 is the first threshold value Th1 or more at each predetermined time interval (for example, sampling intervals of sound signal), increments the counter value when the value of the envelope 721 is the first threshold value Th1 or more, and decrements the counter value when it is less than the first threshold value Th1.

Figure 7D:
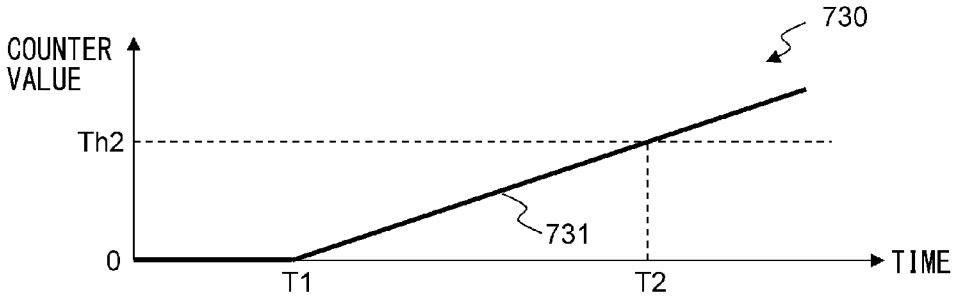
FIG. 7D is a graph which shows an example of a counter value.

FIG. 7D is a graph which shows an example of the counter value which is calculated for the shape of the signal of the absolute value of the sound signal. The graph 730 which is shown in FIG. 7D expresses the counter value which is calculated for the envelope 721 of the graph 720. The abscissa of the graph 720 shows the time, while the ordinate shows the counter value.

Next, the sound jam detector 153 determines whether the counter value is a second threshold value Th2 or more (step S305). The sound jam detector 153 determines that a sound jam has occurred if the counter value is the second threshold value Th2 or more (step S306), determines that a sound jam has not occurred if the counter value is less than the second threshold value Th2 (step S307), and then ends the series of steps.

In FIG. 7C, the envelope 721 is the first threshold value Th1 or more at the time T1 and thereafter does not become less than the first threshold value Th1. For this reason, as shown in FIG. 7D, the counter value increases from the time T1 and becomes the second threshold value Th2 or more at the time T2, then the sound jam detector 153 determines that a sound jam has occurred.

Note that, at step S303, instead of acquiring the envelope as the shape of the signal of the absolute value of the sound signal, the sound jam detector 153 may acquire a signal of the peak hold for the signal of the absolute value of the sound signal (below, referred to as the "peak hold signal"). For example, the central processing unit 150 holds the local maximum value of the signal of the absolute value of the sound signal for exactly a predetermined hold period and then attenuates it by a constant attenuation rate to acquire the peak hold signal.

Figure 8A:
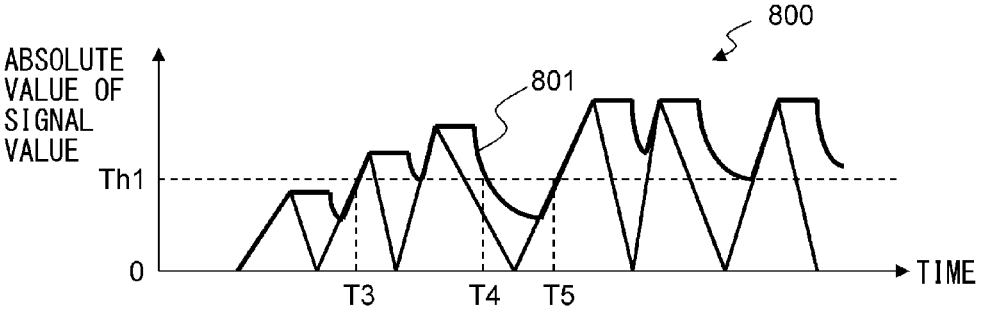
FIG. 8A is a view for explaining processing for detection of an occurrence of a jam.
Figure 8B:
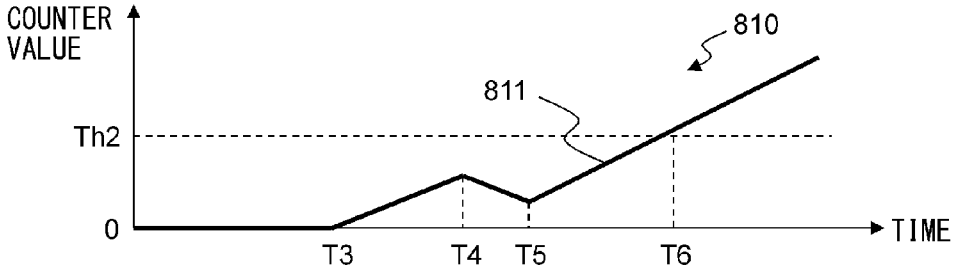
FIG. 8B is a view for explaining processing for detection of an occurrence of a jam.

FIG. 8A and FIG. 8B are views for explaining the processing for acquiring the peak hold signal from the sound signal and determining whether a sound jam has occurred.

The graph 800 which is shown in FIG. 8A expresses the peak hold signal 801 for the signal of the absolute value of the sound signal of the graph 710. The abscissa of the graph 800 shows the time, while the ordinate shows the absolute value of the signal value of the sound signal.

The graph 810 which is shown in FIG. 8B shows the counter value which was calculated for the peak hold signal 801 of the graph 800. The abscissa of the graph 810 shows the time, while the ordinate shows the counter value. The peak hold signal 801 becomes the first threshold value Th1 or more at the time T3, becomes less than the first threshold value Th1 at the time T4, again becomes the first threshold value Th1 or more at the time T5, and does not become less than the first threshold value Th1 after that. For this reason, as shown in FIG. 8B, the counter value increases from the time T3, decreases from the time T4, again increases from the time T5, and becomes the second threshold value Th2 or more at the time T6, so it is determined that a sound jam has occurred.

Figure 9A:
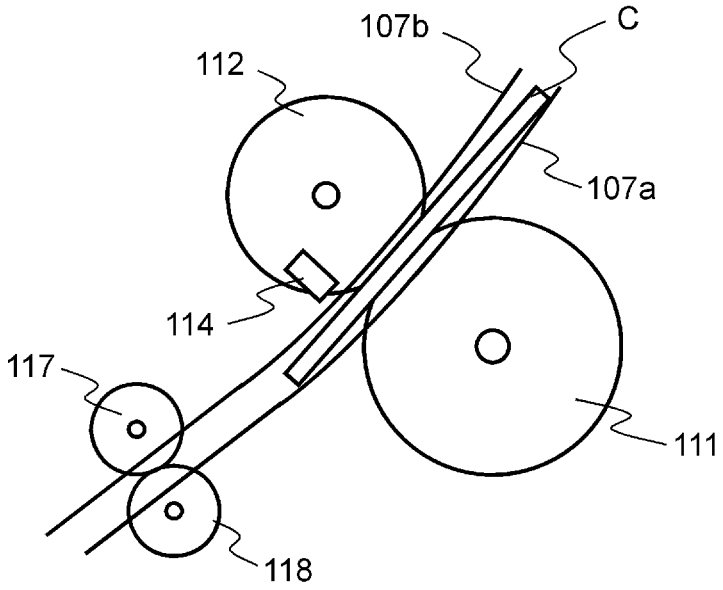
FIG. 9A is a view for explaining a case where a card is conveyed.
Figure 9B:
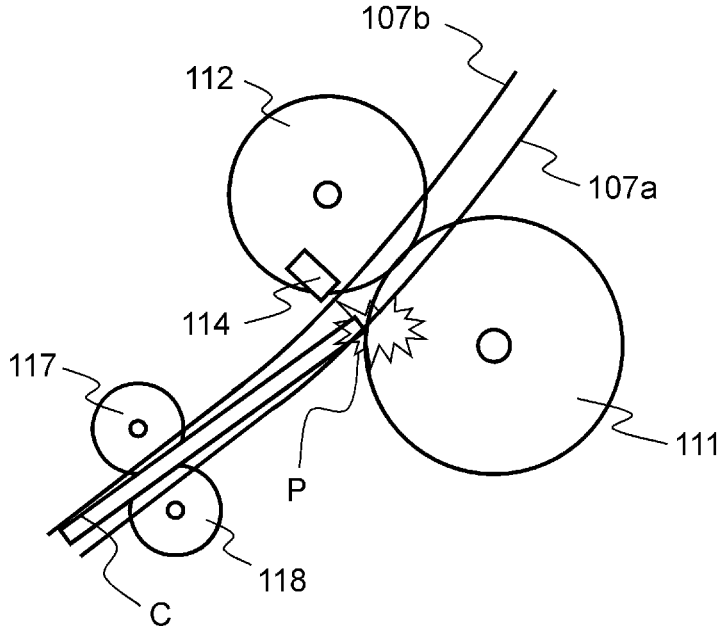
FIG. 9B is a view for explaining a case where a card is conveyed.

FIG. 9A and FIG. 9B are views for explaining the case where a card is conveyed.

FIG. 9A shows the state where a plastic or other high rigidity card C is gripped between the paper feed roller 111 and the retard roller 112. If the card C is further conveyed from the state of FIG. 9A, the state of FIG. 9A shifts to the state of FIG. 9B.

The upper guide 107*b* and the lower guide 107*a* are arranged bent, so if the card C is further gripped by the first conveyor roller 116 and the first driven roller 117 in the state gripped between the paper feed roller 111 and the retard roller 112, it deforms due to its elasticity. For this reason, as shown in FIG. 9B, when the rear end of the card C separates from the paper feed roller 111 and the retard roller 112, the card C tries to return to its original state from the deformed state, so sometimes contacts the lower guide 107*a* at the point P and impact sound is issued. The impact sound which is generated when the card C contacts the lower guide 107*a* ends up being detected by the microphone 113.

The sound jam detector 153 may mistakenly determine that a jam has occurred due to the above detected impact sound. Note that, FIG. 9A and FIG. 9B show an example of a conveyance path in which an impact sound is emitted at the time of separation from the conveyor roller, but the invention is not limited to this. Further, in addition to a plastic card as well, a high rigidity thick paper may also emit an impact sound similar to a plastic card. Furthermore, even if the conveyance path is not bent, an impact sound may be emitted due to the step difference of the rollers.

Figure 10:
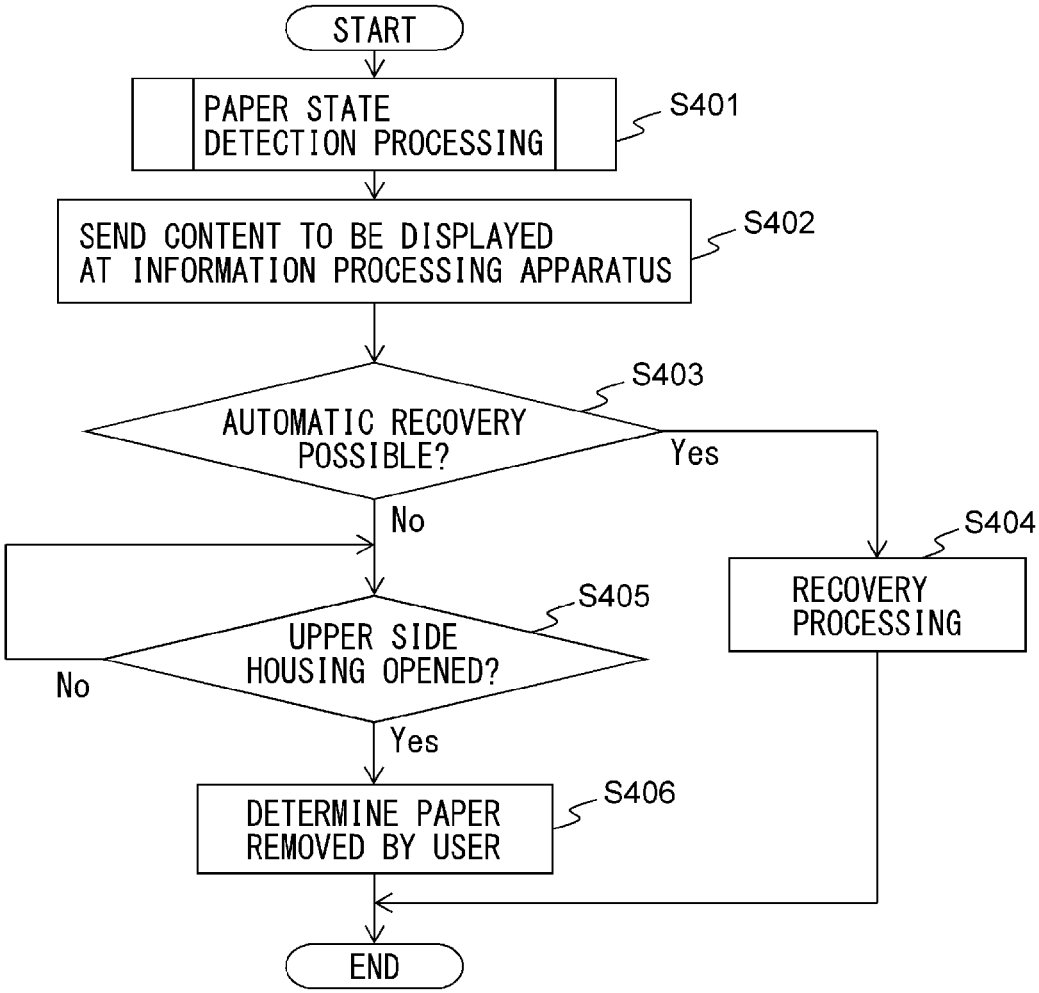
FIG. 10 is a flow chart which shows an example of the operation in recovery determination processing.

FIG. 10 is a flow chart which shows an example of the operation of recovery determination processing.

The flow of operation which is shown in FIG. 10 is executed at step S106 of the flow chart which is shown in FIG. 4.

First, the recovery processing module 153 performs paper state detection processing (step S401). The recovery processing module 153 determines the state of the paper in the paper state detection processing based on the content of detection of the paper state detector 145 and determines the content of recovery processing in accordance with the results of determination and the content to be displayed on the information processing apparatus 10. The content which is displayed at the information processing apparatus 10 includes the state of the paper and the content of the recovery processing. Details of the paper state detection processing will be explained later.

Next, the recovery processing module 153 transmits information which shows the content to be displayed on the information processing apparatus 10 which was determined in the paper state detection processing through the interface 147 to the information processing apparatus 10 (step S402). When the information processing apparatus 10 receives that information from the paper conveying apparatus 100, it displays a state notification screen which indicates the content which is shown in the received information.

Figure 11A:
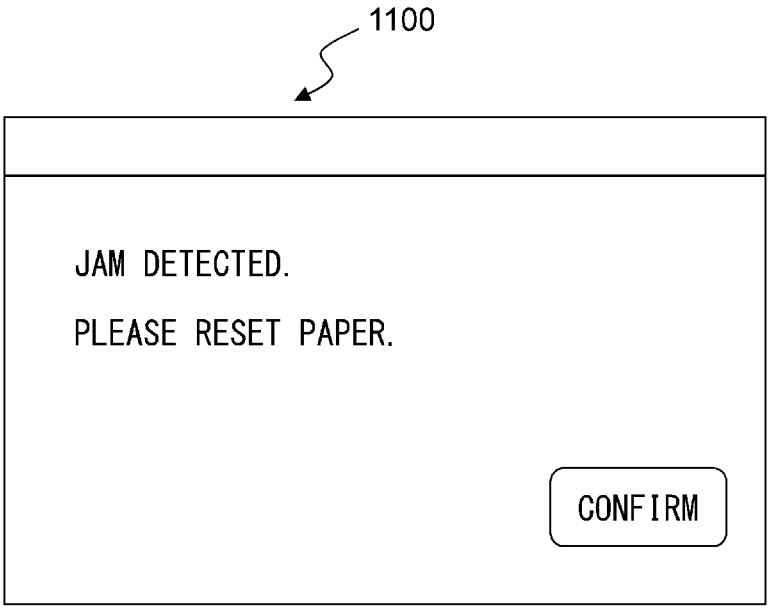
FIG. 11A is a view which shows an example of a state notification screen 1100
Figure 11B:
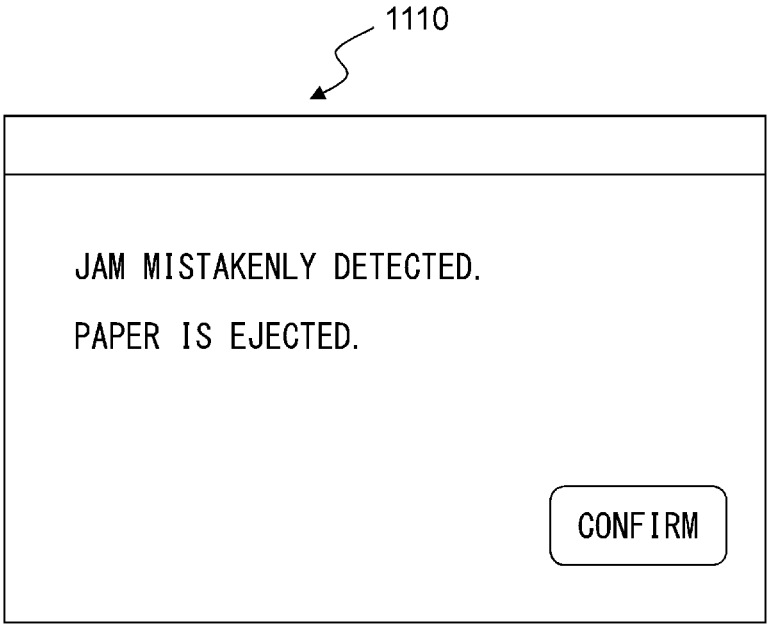
FIG. 11B is a view which shows an example of a state notification screen 1110.

FIG. 11A and FIG. 11B are views which show examples of a state notification screen 1100 and a state notification screen 1110.

The state notification screen 1100 which is shown in FIG. 11A shows an example of the case where a jam occurs and automatic recovery is not possible in the paper state detection processing, while the state notification screen 1110 which is shown in FIG. 11B shows an example of the case where a jam is mistakenly detected and automatic recovery is possible. As shown in FIG. 11A and FIG. 11B, the state notification screen 1100 and the state notification screen 1110 display as states regarding paper conveyance by the apparatus the detection of a jam, mistaken detection of a jam, detection of a card, detection of a multifeed of papers, etc. Furthermore, when it is determined that automatic recovery is not possible, the fact of the paper having to be reset is displayed as shown in the state notification screen 1100. On the other hand, when it is determined that automatic recovery is possible, ejection of the paper or papers, rereading of the paper, etc. is displayed, as the content of the recovery processing, as shown in the state notification screen 1110.

Next, the recovery processing module 153 determines whether it has been determined that performing automatic recovery is possible in the paper state detection processing (step S403).

Next, the recovery processing module 153 performs the recovery processing which was determined in the paper state detection processing when determining that automatic recovery is possible in the paper state detection processing (step S404) and ends the series of steps.

On the other hand, the recovery processing module 153 stands by until the fact of the upper side housing 102 being opened is detected by the opening detector 113 when it is determined that automatic recovery is not possible in the paper state detection processing (step S405). The recovery processing module 153 determines that the upper side housing 102 has been opened if the value of the opening detection signal from the opening detector 113 changes from a value showing the state where the upper side housing 102 is closed to a value showing the state where it is opened.

Next, the recovery processing module 153 determines that the user has removed the paper when the fact of the upper side housing 102 being opened is detected by the opening detector 113 (step S406) and ends the series of steps.

Figure 12:
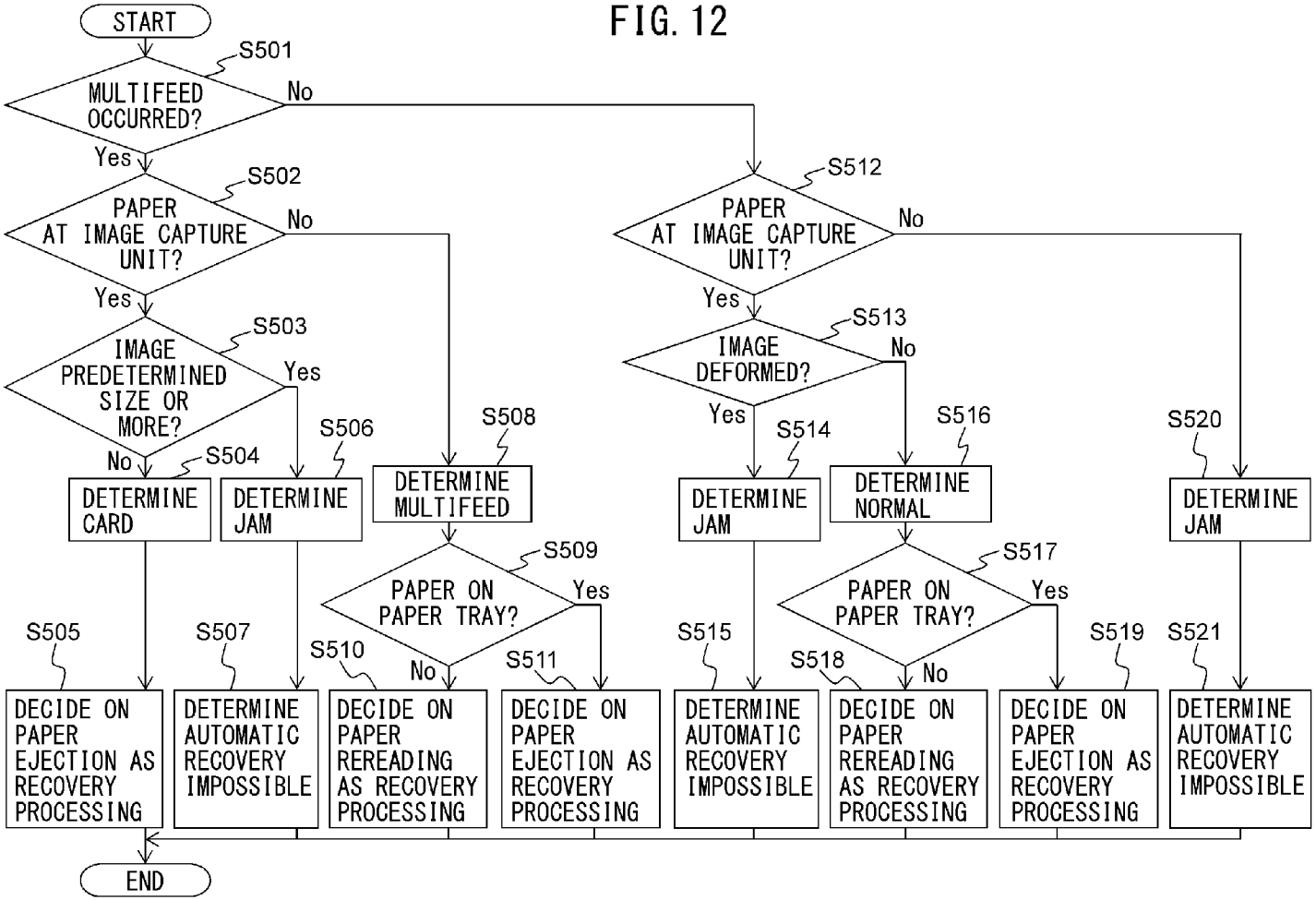
FIG. 12 is a flow chart which shows an example of operation of paper state detection processing.

FIG. 12 is a flow chart which shows an example of the operation of paper state detection processing.

The flow of operation which is shown in FIG. 12 is executed at step S401 of the flow chart which is shown in FIG. 10.

First, the recovery processing module 153 determines whether the multifeed occurrence flag is ON (step S501). This multifeed occurrence flag is set to OFF when starting conveyance of a paper and is set to ON when it is determined in the later explained multifeed detection processing by the multifeed detector 155 that a multifeed of papers has occurred.

When the multifeed occurrence flag is ON, the recovery processing module 153 determines as to if there is a paper at the position of the image capture unit 120 (step S502). The recovery processing module 153 determines that there is a paper at the position of the image capture unit 120 when the value of a third position detection signal from a third position detector 119 indicates the state where a paper is present, while determines that there is no paper present at the position of the image capture unit 120 when it indicates a state where no paper is present.

When a paper is present at the position of the image capture unit 120, the recovery processing module 153 determines whether the size of a read image which an image generator 152 acquires in a direction perpendicular to the paper conveyance direction is a predetermined size or more (step S503). The predetermined size may for example be made the size (85.6 mm) prescribed by the standards of the JIS (Japanese Industrial Standards) as long side sizes of credit cards, cash cards, etc., plus a margin (100 mm).

If the size of the read image is not a predetermined size or more, the recovery processing module 153 determines that a card or thick paper being conveyed has caused the multifeed detector 155 to determine occurrence of a multifeed and has caused the sound jam detector 154 to determine occurrence of a sound jam (step S504). In this case, in actuality, a jam has not occurred and the card or thick paper can again be conveyed, so the recovery processing module 153 determines that automatic recovery is possible and decides on ejection of the paper (card) as the recovery processing (step S505). Further, the recovery processing module 153 decides that the content to be displayed at the information processing apparatus 10 is that a card is detected and a paper (card) will be ejected when a user strikes the apparatus, and then ends the series of steps.

On the other hand, when the size of the read image is a predetermined size or more, the recovery processing module 153 determines that the results of detection of the sound jam detector 154 and the multifeed detector 155 were correct and a multifeed and jam of a paper occurred (step S506). In this case, the recovery processing module 153 determines that automatic recovery is not possible (step S507). Further, the recovery processing module 153 decides that the content to be displayed at the information processing apparatus 10 is that a jam is detected and a user needs to reset a paper, and then ends the series of steps.

When there was no paper present at the position of the image capture unit 120 at step S502, the recovery processing module 153 determines that conveyance of superposed papers having wrinkles caused the multifeed detector 155 to determine the occurrence of a multifeed and caused the sound jam detector 154 to determine the occurrence of a sound jam (step S508). In this case, no jam has actually occurred and the paper can be again conveyed, so the recovery processing module 153 determines that automatic recovery is possible.

Next, the recovery processing module 153 determines whether a paper is placed on the paper tray 103 based on a first position detection signal which is received from the first position detector 110 (step S509). When a paper is not placed on the paper tray 103, the paper being conveyed can be returned to the paper tray 103, so the recovery processing module 153 decides to reread the paper as recovery processing (step S510). In this case, in the recovery processing, the recovery processing module 153 rotates the paper feed roller 111 in a direction opposite to the usual one (direction of arrow a3 of FIG. 2) to return the paper once to the paper tray 103, then again convey it. Further, the recovery processing module 153 decides that the content to be displayed at the information processing apparatus 10 is that a multifeed is detected and the paper will be reread when a user strikes the apparatus, and ends the series of steps.

On the other hand, when a paper is placed on the paper tray 103, a paper being conveyed cannot be returned to the paper tray 103, so the recovery processing module 153 decides on ejection of the paper or papers as recovery processing (step S511). Further, the recovery processing module 153 that the content to be displayed at the information processing apparatus 10 is that a multifeed is detected and the paper will be ejected when a user strikes the apparatus, and ends the series of steps.

When the multifeed occurrence flag is not ON at step S501, the recovery processing module 153 determines whether a paper is present at the position of the image capture unit 120 (step S512).

If there is a paper present at the position of the image capture unit 120, the recovery processing module 153 determines whether the read image acquired by the image generator 152 has deformed due to a jam (step S513). The recovery processing module 153 determines that the read image has deformed due to a jam when the read image is not substantially rectangular and determines that the read image has not deformed due to a jam when the read image is substantially rectangular. Note that, at the point of time when this determination is performed, the paper is stopped, so there is a possibility that the read image has not read the paper as a whole. Therefore, the recovery processing module 153 determines that the read image is substantially rectangular when the sides indicating the front end, left end, and right end of the paper toward the direction of conveyance in the read image are substantially straight and the side indicating the front end of the paper and the sides indicating the left and right ends are substantially perpendicular. On the other hand, the recovery processing module 153 determines that the read image is not substantially rectangular when any of the sides indicating the front end, left end, and right end of the paper in the read image is not substantially straight or the side indicating the front end of the paper and the sides indicating the left and right ends are not substantially perpendicular.

When the read image is deformed, the recovery processing module 153 determines that the result of detection of the sound jam detector 154 was corrected and a jam occurred (step S514) and determines that automatic recovery is impossible (step S515). Further, the recovery processing module 153 decides that the content to be displayed at the information processing apparatus 10 is that a jam is detected and a user needs to reset the paper, and ends the series of steps.

On the other hand, when the read image is not deformed, the recovery processing module 153 determines that the result of detection of the sound jam detector 154 was mistaken and the state is normal (step S516). In this case, no jam has actually occurred and the paper can be conveyed again, so the recovery processing module 153 determines that automatic recovery is possible.

Next, the recovery processing module 153 determines whether a paper is placed on the paper tray 103 (step S517). When a paper is not placed on the paper tray 103, the paper being conveyed can be returned to the paper tray 103, so the recovery processing module 153 decides on rereading of the paper as the recovery processing (step S518). Further, the recovery processing module 153 decides that the content to be displayed at the information processing apparatus 10 is that a jam is mistakenly detected and the paper will be reread, and then ends the series of steps.

On the other hand, when a paper is placed on the paper tray 103, the paper being conveyed cannot be returned to the paper tray 103, so the recovery processing module 153 decides on ejection of the paper as the recovery processing (step S519). Further, the recovery processing module 153 decides that the content to be displayed at the information processing apparatus 10 is that a jam is mistakenly detected and the paper will be ejected, and then ends the series of steps.

When there is no paper present at the position of the image capture unit 120 at step S512, the recovery processing module 153 determines that the result of detection of the sound jam detector 154 was correct and a jam has occurred (step S520) and determines that automatic recovery is not possible (step S521). Further, the recovery processing module 153 decides that the content to be displayed at the information processing apparatus 10 is that a jam is detected and a user needs to reset the paper, and ends the series of steps.

Note that, the control module 151 does not stop conveyance of the paper immediately after the sound jam detector 154 determines that a jam has occurred, but it may also determine whether to stop conveyance of a paper, considering the presence of a multifeed, the size and shape of a read image, and other aspects of the state of a paper. However, detection of the state of a paper takes time, so a paper is liable to be conveyed and damaged during that time.

Therefore, in the paper conveying apparatus 100, if the sound jam detector 154 determines that a jam has occurred, the control module 151 stops the conveyance of the paper temporarily (see FIG. 4, step S105). Further, after that, the recovery processing module 153 determines the state of a paper based on the result of detection of the paper state detector 145 and automatically performs the recovery processing in accordance with the result of detection.

Note that, when the result of detection of the sound jam detector 154 is mistaken such as at steps S505, S511, and S519, after that as well, there is a possibility that a paper is stopped due to mistaken detection of a jam. Therefore, the recovery processing module 153 may make the setting screen regarding detection of a sound jam be displayed on the information processing apparatus 10 so as to prompt the user to change the settings for the detection of a sound jam.

Figure 13:
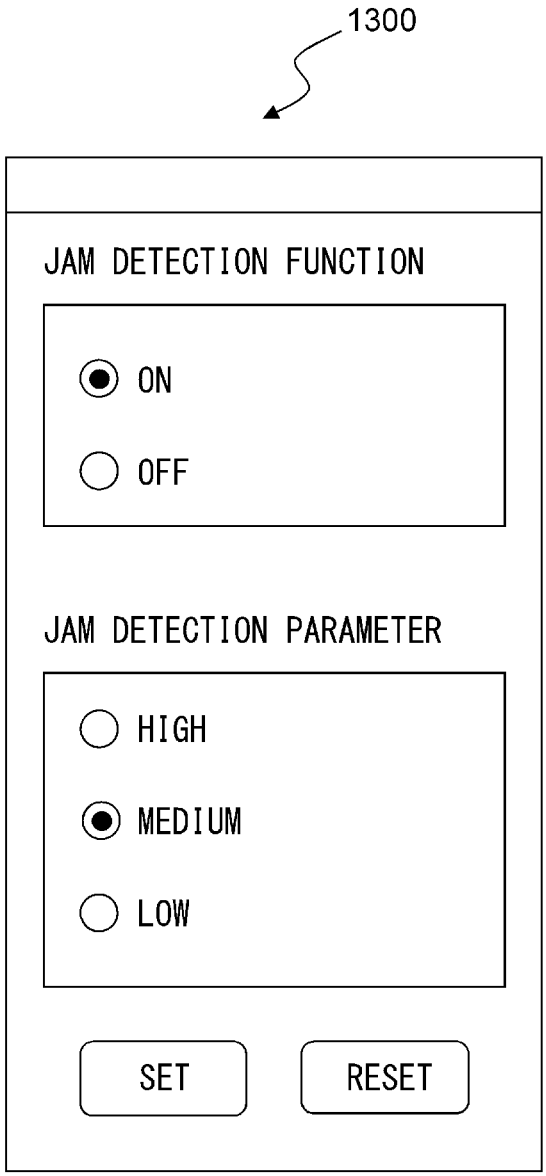
FIG. 13 is a view which shows an example of a setting screen 1300 for sound jam detection.

FIG. 13 is a view which shows an example of the setting screen 1300 for detection of a sound jam.

As shown in FIG. 13, the setting screen 1300 displays select buttons for the user to set the jam detection function ON or OFF and select buttons for setting the jam detection parameters. When the ON/OFF state of the jam detection function and the jam detection parameters are selected by the user and the set button is pushed, the information processing apparatus 10 sends a setting notification which indicates the selected information to the paper conveying apparatus 100.

When the interface 147 of the paper conveying apparatus 100 receives a setting notification from the information processing apparatus 10, it sends the received setting notification to the recovery processing module 153. The recovery processing module 153 sets the jam detection function in accordance with the setting notification received from the interface 147. The recovery processing module 153 controls so that when the jam detection function has been set OFF, the control module 151 subsequently does not stop the conveyance of the paper due to detection of a sound jam. Further, when the jam detection function has been set ON, the recovery processing module 153 changes the first threshold value TH1 or the second threshold value TH2 in accordance with the set jam detection parameters and performs control so that the sound jam detector 154 changes the method of detection of a jam. By making the first threshold value Th1 or second threshold value Th2 larger, it is possible to make it harder to determine that a jam has occurred, while by making the first threshold value Th1 or second threshold value Th2 smaller, it is possible to make it easier to determine that a jam has occurred.

Furthermore, when deciding on rereading of a paper as recovery processing such as at steps S510 and S518, the recovery processing module 153 may automatically set the jam detection function OFF so that the paper does not stop again at the time of rereading a paper. Alternatively, the recovery processing module 153 also may automatically increase the first threshold value Th1 or second threshold value Th2 so as to make it more difficult to determine that a jam has occurred.

Further, even when ejecting a paper as recovery processing such as at steps S505, S511, and S519, the recovery processing module 153 may automatically set the jam detection function OFF or change the jam detection parameters.

Further, when determining that a multifeed of papers has occurred such as at steps S511, the recovery processing module 153 may display the setting screen of the conveyance speed on the information processing apparatus 10 so as to prompt the user to change the settings of the conveyance speed, so that a multifeed of papers does not subsequently occurred.

Figure 14:
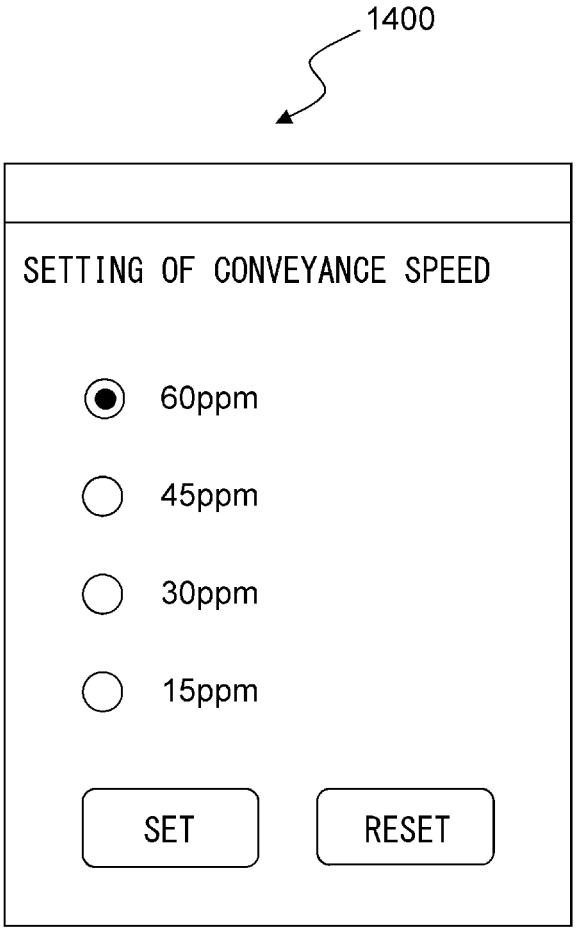
FIG. 14 is a view which shows an example of a setting screen 1400 of the conveyance speed.

FIG. 14 is a view which shows an example of a setting screen 1400 of the conveyance speed.

As shown in FIG. 14, the setting screen 1400 displays a select button for the conveyance speed of a paper to be selected by a user. If the conveyance speed is selected by the user and the set button is depressed, the information processing apparatus 10 sends conveyance speed information which indicates the selected conveyance speed to the paper conveying apparatus 100. If the interface 147 of the paper conveying apparatus 100 receives resolution information from the information processing apparatus 10, it sends the received conveyance speed information to the recovery processing module 153. The recovery processing module 153 sets a rotational speed of a drive unit 146 in accordance with information of the conveyance speed which is received from the interface 147.

Furthermore, when deciding on rereading the paper as recovery processing such as at step S510, the recovery processing module 153 may automatically make the conveyance speed of the paper fall so that a multifeed does not occur again at the time of reading a paper.

Further, even when ejecting a paper as recovery processing such as at step S511, the recovery processing module 153 may automatically make the conveyance speed of the paper fall.

Figure 15:
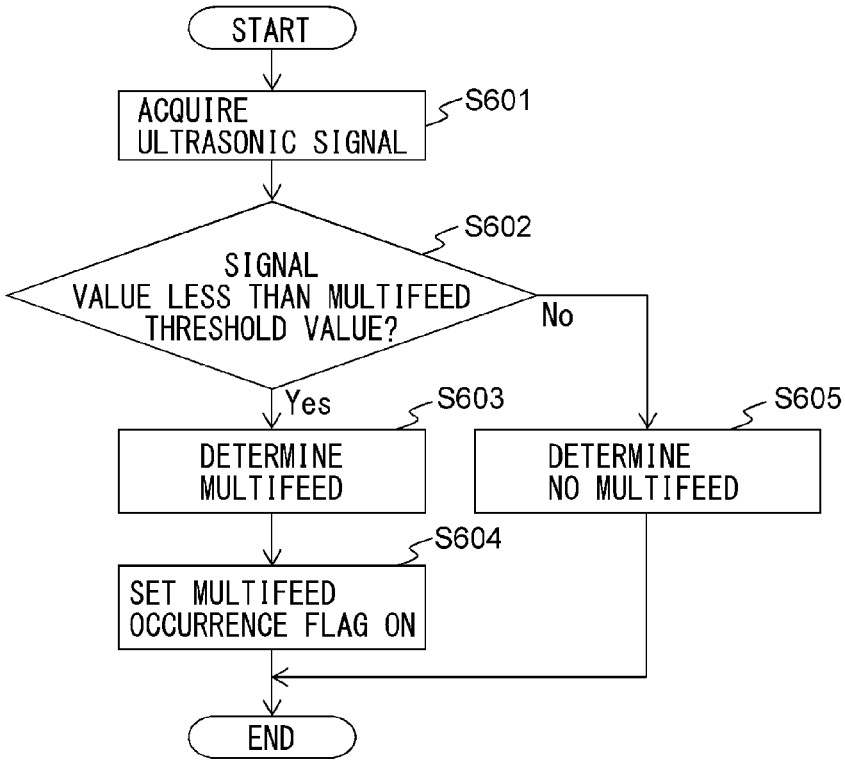
FIG. 15 is a flow chart which shows an example of operation of multifeed detection processing.

FIG. 15 is a flow chart which shows an example of operation of multifeed detection processing.

The flow of operation which is shown in FIG. 15 is performed mainly by the central processing unit 150 in cooperation with the components of the paper conveying apparatus 100 based on a program which is stored in advance in the storage unit 148. The flow which is shown in FIG. 15 is performed every predetermined time interval.

First, the multifeed detector 155 acquires an ultrasonic signal from the ultrasonic sensor 115 (step S601).

Next, the multifeed detector 155 determines whether the signal value of the acquired ultrasonic signal is less than the multifeed detection threshold value (step S602).

Figure 16:
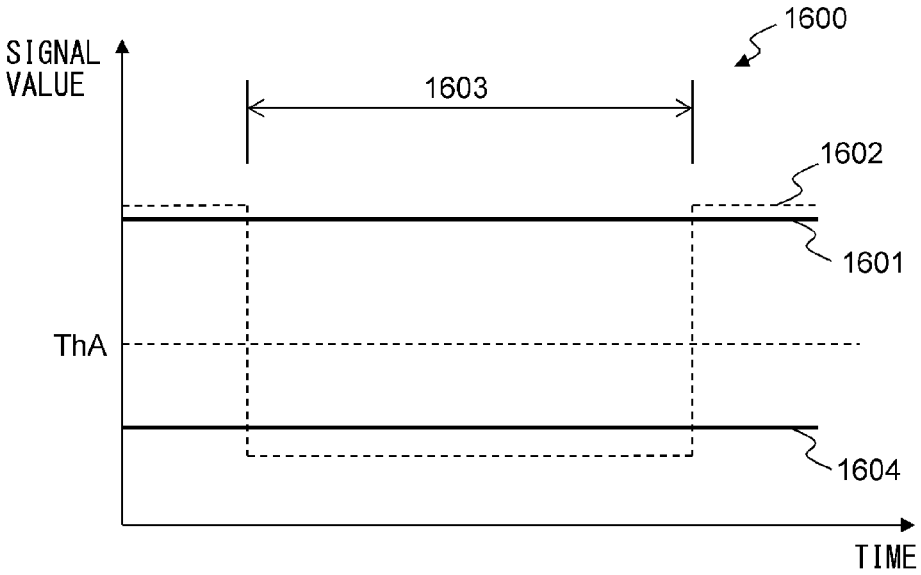
FIG. 16 a view for explaining properties of an ultrasonic signal.
Figure 17:
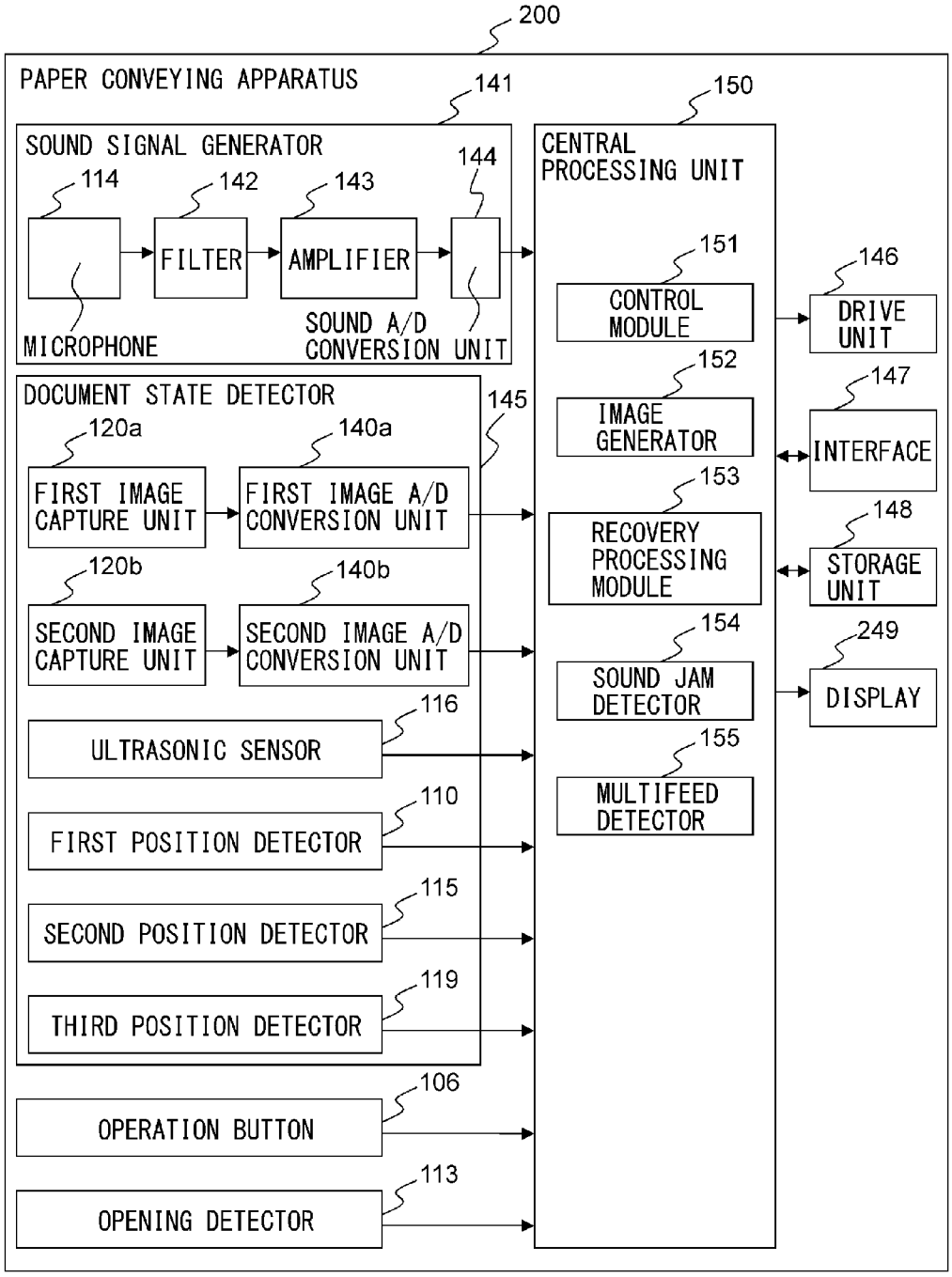
FIG. 17 is a block diagram which shows the schematic configuration of a paper conveying apparatus 200 corresponding to another embodiment.

FIG. 16 is a view for explaining properties of an ultrasonic signal.

In the graph 1600 of FIG. 16, the solid line 1601 shows the characteristic of the ultrasonic signal in the case where a single paper is conveyed, while the broken line 1602 shows the characteristic of the ultrasonic signal in the case where multifeed of papers has occurred. The abscissa of the graph 1600 shows the time, while the ordinate shows the signal value of the ultrasonic signal. Due to the occurrence of multifeed, the signal value of the ultrasonic signal of the broken line 1602 falls in the section 1603. For this reason, it is possible to determine whether multifeed of papers has occurred by whether the signal value of the ultrasonic signal is less than the multifeed detection threshold value ThA.

On the other hand, the solid line 1604 shows the characteristic of the ultrasonic signal in the case where just one plastic card thicker than paper is conveyed. When a card is conveyed, the signal value of the ultrasonic signal becomes smaller than the multifeed detection threshold value ThA, so the multifeed detector 155 mistakenly determines that a multifeed of papers has occurred. Note that, even if sufficiently thick, high rigidity thick paper has been conveyed, an ultrasonic signal which has characteristics similar to the case where a plastic card is conveyed is detected, so the multifeed detector 155 is liable to mistakenly determine that a multifeed of papers has occurred.

When the signal value of the ultrasonic signal is less than the multifeed detection threshold value, the multifeed detector 155 determines that multifeed of the papers has occurred (step S603), sets the multifeed occurrence flag ON (step S604), and ends the series of steps. On the other hand, when the signal value of the ultrasonic signal is the multifeed detection threshold value or more, the multifeed detector 155 determines that multifeed of the papers has not occurred (step S605), and ends the series of steps.

As explained in detail above, the paper conveying apparatus 100 operates in accordance with the flow chart which is shown in FIG. 4, FIG. 5, FIG. 6, FIG. 10, and FIG. 12 to thereby stop conveyance of a paper once when a jam has occurred during conveyance of the paper, then automatically perform recovery processing in accordance with the state of the paper. Therefore, the paper conveying apparatus 100 becomes able to keep damage of a paper to a minimum extent while improving the user friendliness of the recovery processing.

Furthermore, when mistakenly detecting a jam, the paper conveying apparatus 100 prompts the user to change the settings regarding the detection of a sound jam or automatically changes the settings, so can suppress subsequent mistaken detection of a jam.

Furthermore, when a multifeed of papers occurs, the paper conveying apparatus 100 prompts the user to change the settings of the conveyance speed of a paper or automatically changes the settings, and thus can prevent subsequent occurrence of a multifeed.

FIG. 16 is a block diagram which shows the general configuration of another paper conveying apparatus 200 according to another embodiment.

The paper conveying apparatus 200 which is shown in FIG. 16 has a display 249 in addition to the components of the paper conveying apparatus 100 which is shown in FIG. 3.

The display 249 has a touch panel type display and an interface circuit which receives as input a signal corresponding to the operation of the touch panel by the user and outputs an image to the display. The display 249 outputs the signal corresponding to the operation by the user to the central processing unit 150 and displays the image on the display in accordance with control from the central processing unit 150.

In the paper conveying apparatus 200, the recovery processing module 153 makes the state notification screen 1100 which is shown in FIG. 11A, the state notification screen 1110 which is shown in FIG. 11B, the setting screen 1300 of FIG. 13, the setting screen 1400 of FIG. 14, etc. be displayed on the display 249 instead of making them be displayed on the information processing apparatus 10. Further, the recovery processing module 153 receives changes in settings regarding the detection of a sound jam and changes in settings of the conveyance speed from the user through the display 249 instead of receiving them through the information processing apparatus 10.

As explained in detail above, the paper conveying apparatus 200 makes the display 249 display the content of the recovery processing, so a user can confirm the state of a paper by the display 249 of the paper conveying apparatus 200.

According to the paper conveying apparatus and the recovery method, and the computer-readable, non-transitory medium, the paper conveying apparatus determines that a jam has occurred during conveyance of a paper, stops the conveyance of the paper, then automatically performs recovery processing in accordance with the state of the paper, so can improve the user friendliness.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment(s) of the present inventions have been described in detail, it should be understood that the various changes, substitutions, and alterations could be made hereto without departing from the spirit and scope of the invention.

What is claimed is:

1. A paper conveying apparatus comprising:

a sound signal generator for generating a sound signal;

a sound jam detector for determining whether a jam has occurred based on the sound signal;

a control module for stopping conveyance of a paper when the sound jam detector determines that the jam has occurred;

a paper state detector for detecting a state of the paper; and a recovery processing module for performing a recovery processing which resumes conveyance of the paper when the paper state detector detects that the jam determination by the sound jam detector is a false determination after stopping the conveyance of the paper by the control module.

2. The paper conveying apparatus according to claim 1, wherein the paper state detector includes an image reader for reading an image from the paper to output an image signal, and wherein the recovery processing module performs the recovery processing in accordance with the image signal.

3. The paper conveying apparatus according to claim 2, wherein the recovery processing module ejects the paper when the recovery processing module determines that the image is substantially rectangular.

4. The paper conveying apparatus according to claim 2, wherein the recovery processing module ejects the paper when the recovery processing module determines that a length of the image in a direction perpendicular to a paper conveyance direction is less than a predetermined value.

5. The paper conveying apparatus according to claim 2, wherein the recovery processing module controls the control module so that the control module does not stop the conveyance of the paper due to the detection of the jam by the sound jam detector, after the recovery processing module performs the recovery processing.

6. The paper conveying apparatus according to claim 2, wherein the recovery processing module controls the sound jam detector so that the sound jam detector changes the jam detection method, when the recovery processing module performs the recovery processing.

7. A recovery method comprising:

acquiring a sound signal from a sound signal generator for generating a sound signal;

determining whether a jam has occurred based on the sound signal;

stopping conveyance of a paper when determining that the jam has occurred in the determining step;

acquiring a state of the paper from a paper state detector for detecting a state of the paper; and performing, by a computer, a recovery processing which resumes conveyance of the paper when the paper state detector detects that the jam determination in the determining step is a false determination after stopping the conveyance of the paper in the stopping step.

8. A computer-readable, non-transitory medium storing a computer program, wherein the computer program causes a computer to perform a process, the process comprising:

acquiring a sound signal from a sound signal generator for generating a sound signal;

determining whether a jam has occurred based on the sound signal;

stopping conveyance of a paper when determining that the jam has occurred in the determining step;

acquiring a state of the paper from a paper state detector for detecting a state of the paper; and performing a recovery processing which resumes conveyance of the paper when the paper state detector detects that the jam determination in the determining step is a false determination after stopping the conveyance of the paper in the stopping step.

* * * * *